US005622349A

United States Patent [19]

Rider

[11] Patent Number: 5,622,349

[45] Date of Patent: Apr. 22, 1997

[54] CANVAS HOLDER

[76] Inventor: Lorraine K. Rider, 1828 Old FFA Rd., Fort Pierce, Fla. 34945

[21] Appl. No.: 352,917

[22] Filed: Dec. 9, 1994

[51] Int. Cl.[6] ..... A47B 7/04

[52] U.S. Cl. ..... 248/452

[58] Field of Search ..... 248/451, 452, 248/453, 465.1, 460, 441.1, 442.2, 229.11, 229.21, 228.2, 230.2, 231.31, 316.2, 316.5

[56] References Cited

U.S. PATENT DOCUMENTS

| | | | |
|---|---|---|---|
| 490,569 | 1/1893 | Lehman | 248/453 |
| 544,948 | 8/1895 | Beyer | 248/453 |
| 683,724 | 10/1901 | Carr | 248/453 |
| 939,942 | 11/1909 | Brauchli | 248/452 |
| 1,130,559 | 3/1915 | Allen | 248/442.2 |
| 1,573,443 | 2/1926 | Hallar et al. | 248/316.2 X |
| 1,971,539 | 3/1934 | Snell | 248/451 |
| 2,006,887 | 7/1935 | Doherty | 248/451 X |
| 2,463,451 | 3/1949 | Yates | 248/316.2 |
| 3,899,164 | 8/1975 | Newman | 248/451 X |
| 4,243,335 | 1/1981 | Singley | 248/442.2 X |

FOREIGN PATENT DOCUMENTS

| | | | |
|---|---|---|---|
| 208814 | 4/1968 | Germany | 248/451 |
| 409829 | 5/1934 | United Kingdom | 248/452 |
| 626781 | 7/1949 | United Kingdom | 248/441.1 |

*Primary Examiner*—Ramon O. Ramirez

[57] ABSTRACT

A holder for supporting a section of canvas in an inclined orientation for performance of needlework on the canvas. The inventive device includes a base plate positionable on a support surface. A wire support assembly extends upwardly at an oblique angle from the base plate. A pair of clamps are provided to couple the canvas to the wire support assembly such that needlework can be performed on the canvas.

1 Claim, 4 Drawing Sheets

CANVAS HOLDER

BACKGROUND OF THE INVENTION

1. Field of the Invention

The present invention relates to support structures and more particularly pertains to a canvas holder for supporting a section of canvas in an inclined orientation.

2. Description of the Prior Art

The use of support structures is known in the prior art. More specifically, support structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art support structures include U.S. Pat. No. 4,690,363; U.S. Pat. No. 4,117,936; U.S. Pat. No. 3,823,909; U.S. Pat. No. 3,743,231; and U.S. Pat. No. 3,674,231.

While these devices fulfill their respective, particular objectives and requirements, the aforementioned patents do not disclose a canvas holder for supporting a section of canvas in an inclined orientation which includes a base plate positionable on a support surface, a wire support assembly extending upwardly at an oblique angle from the base plate, and a pair of clamps for coupling the canvas to the wire support assembly such that needlework can be performed on the canvas.

In these respects, the canvas holder according to the present invention substantially departs from the conventional concepts and designs of the prior art, and in so doing provides an apparatus primarily developed for the purpose of supporting a section of canvas in an inclined orientation relative to a support surface.

SUMMARY OF THE INVENTION

In view of the foregoing disadvantages inherent in the known types of support structures now present in the prior art, the present invention provides a new canvas holder construction wherein the same can be utilized for supporting a section of canvas in an inclined orientation relative to a support surface. As such, the general purpose of the present invention, which will be described subsequently in greater detail, is to provide a new canvas holder apparatus and method which has many of the advantages of the support structures mentioned heretofore and many novel features that result in a canvas holder which is not anticipated, rendered obvious, suggested, or even implied by any of the prior art support structures, either alone or in any combination thereof.

To attain this, the present invention generally comprises a holder for supporting a section of canvas in an inclined orientation for performance of needlework on the canvas. The inventive device includes a base plate positionable on a support surface. A wire support assembly extends upwardly at an oblique angle from the base plate. A pair of clamps are provided to couple the canvas to the wire support assembly such that needlework can be performed on the canvas.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new canvas holder apparatus and method which has many of the advantages of the support structures mentioned heretofore and many novel features that result in a canvas holder which is not anticipated, rendered obvious, suggested, or even implied by any of the prior art support structures, either alone or in any combination thereof.

It is another object of the present invention to provide a new canvas holder which may be easily and efficiently manufactured and marketed.

It is a further object of the present invention to provide a new canvas holder which is of a durable and reliable construction.

An even further object of the present invention is to provide a new canvas holder which is susceptible of a low cost of manufacture with regard to both materials and labor, and which accordingly is then susceptible of low prices of sale to the consuming public, thereby making such canvas holders economically available to the buying public.

Still yet another object of the present invention is to provide a new canvas holder which provides in the apparatuses and methods of the prior art some of the advantages thereof, while simultaneously overcoming some of the disadvantages normally associated therewith.

Still another object of the present invention is to provide a new canvas holder for supporting a section of canvas at an oblique angle relative to a support surface.

Yet another object of the present invention is to provide a new canvas holder which includes a base plate positionable on a support surface, a wire support assembly extending upwardly at an oblique angle from the base plate, and a pair of clamps for coupling the canvas to the wire support assembly such that needlework can be performed on the canvas.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
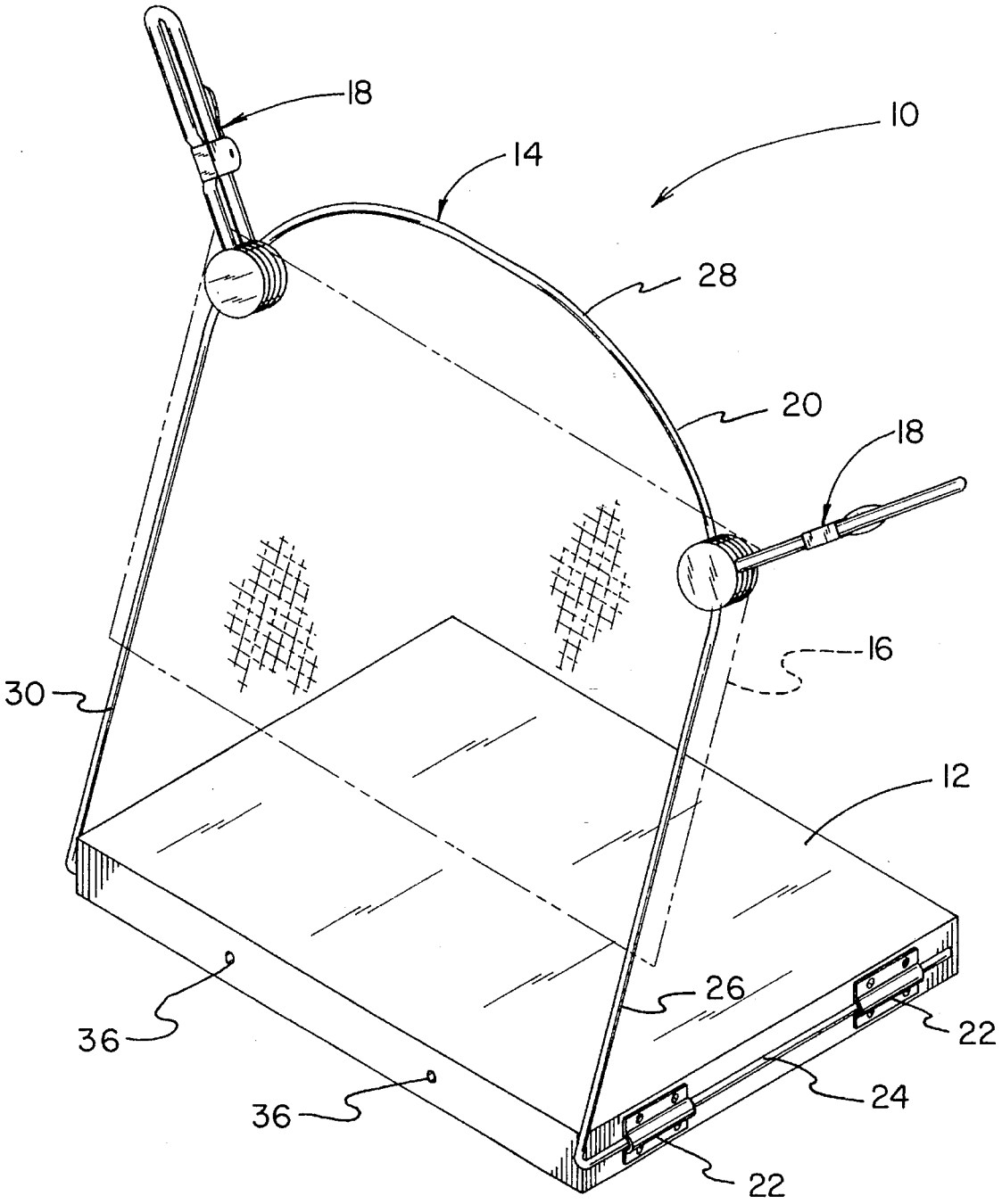
FIG. 1 is an isometric illustration of a canvas holder according to the present invention in use.
Figure 2:
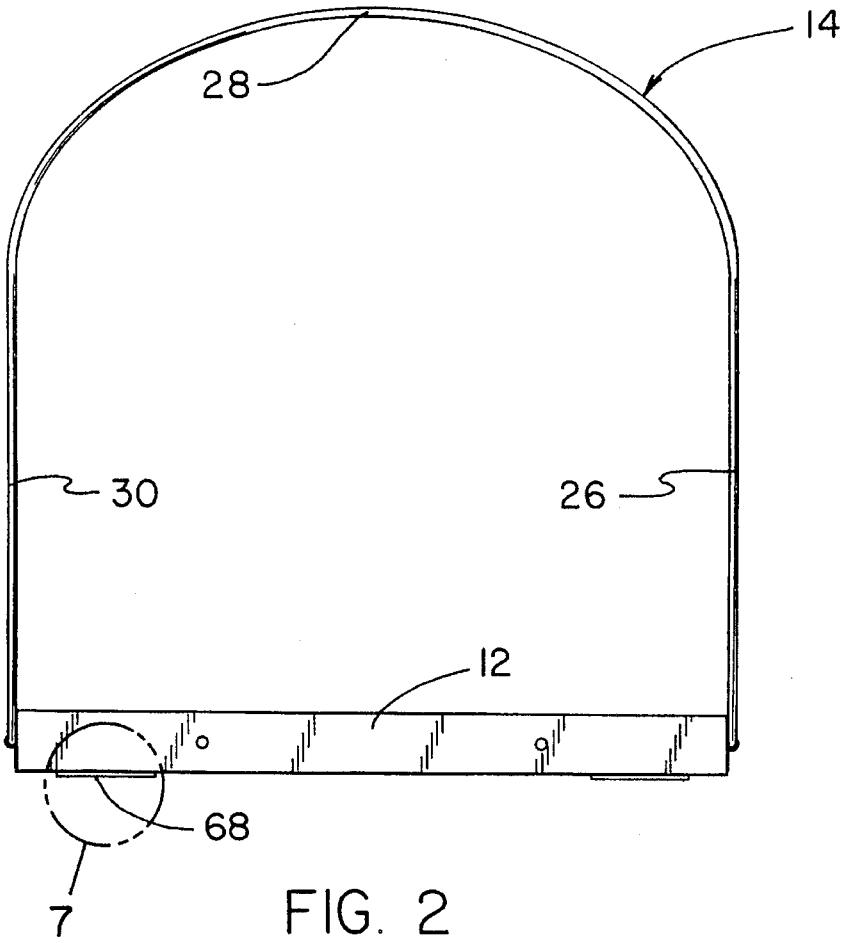
FIG. 2 is a front elevation view of the invention, per se.

With reference now to the drawings, and in particular to FIGS. 1–7 thereof, a new canvas holder embodying the principles and concepts of the present invention and generally designated by the reference numeral 10 will be described.

More specifically, it will be noted that the canvas holder 10 comprises a substantially rectangular base plate 12 positionable upon an unillustrated support surface. A first support means 14 is coupled to the base plate 12 and extends upwardly therefrom at an oblique angle relative to the base plate for supporting a section of canvas 16 in a desired orientation for performance of needlework on the canvas. Clip means 18 are removably coupled to the first support means 14 for securing the canvas 16 relative to the first support means.

Figure 5:
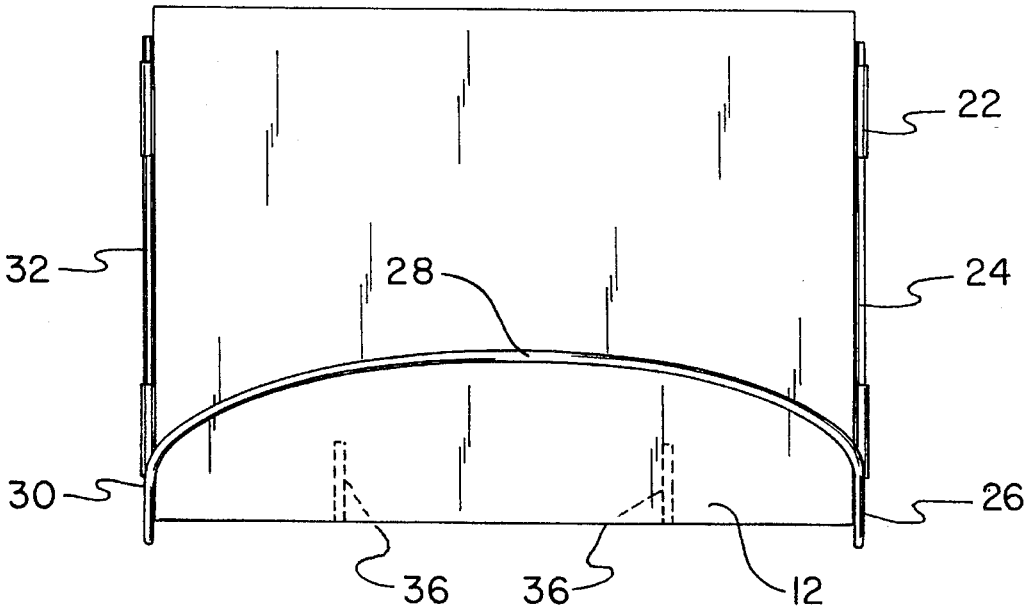
FIG. 5 is a top plan view thereof.

As best illustrated in FIGS. 1 and 5, it can be shown that the first support means 14 according to the present invention 10 preferably comprises a first wire frame 20 removably coupled to opposed lateral edges of the base plate 12 by a plurality of receivers 22 secured to the opposed lateral edges of the base plate. The first wire frame 20 preferably comprises a first mounting rod 24 which can be extended through at least one of the receivers 22 coupled to a first one of the lateral side walls of the base plate 12. The first mounting rod 24 integrally continues into a first vertical rod 26 extending upwardly from the base plate 12 and oriented at an oblique angle relative thereto so as to extend into the inclined orientation illustrated in the drawings. The first vertical rod 26 continues into an arcuate connecting rod 28 traversing across the base plate 12 in a spaced orientation relative thereto to connect with a second vertical rod 30 extending downwardly from the arcuate connecting rod towards a second one of the lateral side walls of the base plate 12. The second vertical rod 30 is oriented so as to extend substantially parallel to the first vertical rod 26 and continues into a second mounting rod 32 (see FIG. 4) which can be received within at least one of the receivers 22 located on a second one of the lateral side walls of the base plate 12. Preferably, the wire frame 20 is entirely formed of a plastic coated wire so as to inhibit surface corrosion and the like which could stain the canvas 16 during use of the device 10.

Figure 3:
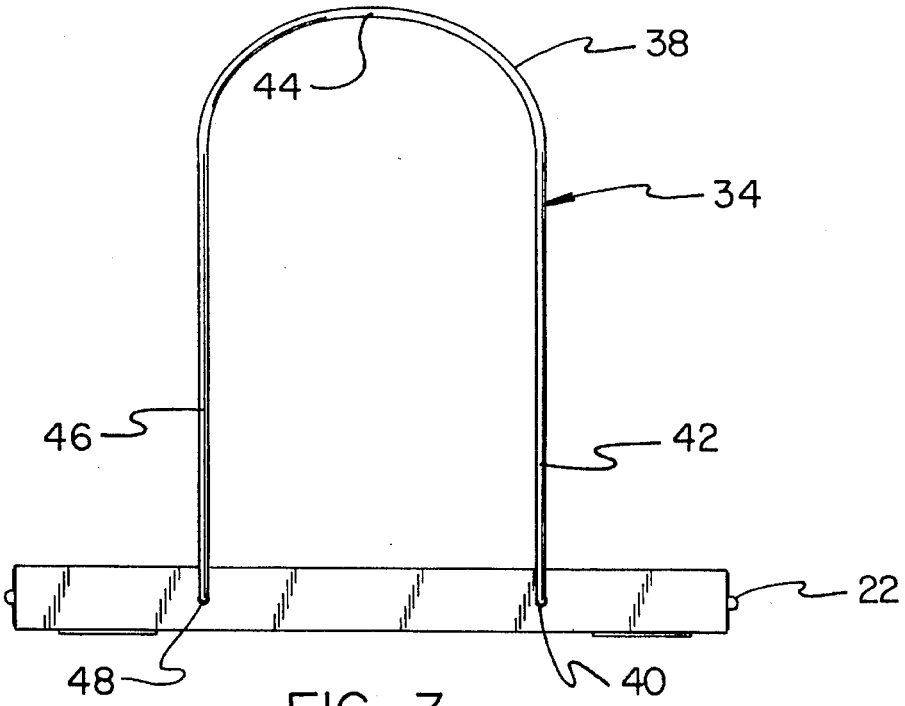
FIG. 3 is a front elevation view of the present invention including a second support means.
Figure 4:
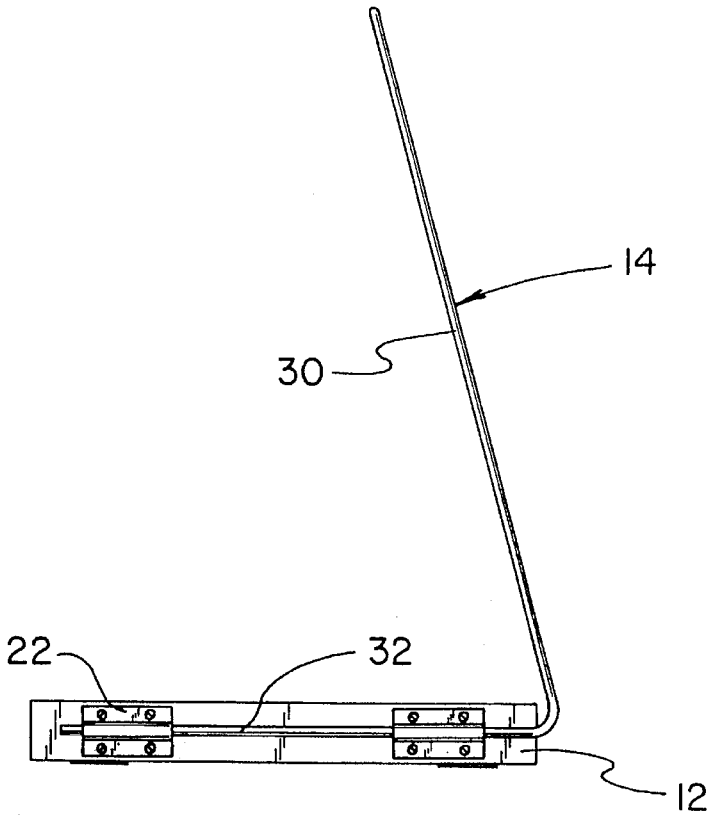
FIG. 4 is a side elevation view of the present invention.

As shown in FIG. 3, the present invention 10 may additionally include a second support means 34 for engaging and supporting a portion of the section of canvas 16. To this end, the base plate 12 is desirably provided with a pair of mounting apertures 36 directed into a front wall thereof and oriented so as to extend substantially parallel to the receivers 22. The second support means 34 comprises a second wire frame 38 formed of a first mounting rod 40 removably positioned within a first one of the mounting apertures 36. The first mounting rod 40 continues into a first vertical rod 42 extending upwardly from the base plate 12 and is oriented at an oblique angle relative thereto. The first vertical rod 42 continues into an arcuate connecting rod 44 extending across the base plate 12 in a spaced orientation relative thereto. The arcuate connecting rod 44 continues into a second vertical rod 46 extending downwardly therefrom and to towards the base plate 12 and into alignment with a second one of the mounting apertures 36. The second vertical rod 46 subsequently continues into a second mounting rod 48 removably positioned within the second one of the mounting apertures 36 to complete the coupling between the second support means 34 and the base plate 12. The second support means 34 can be used in lieu of the first support means 14, or alternatively, the second support means can be utilized in combination with the first support means 14 to impart further support to the section of canvas 16 during use of the device 10.

Figure 6:
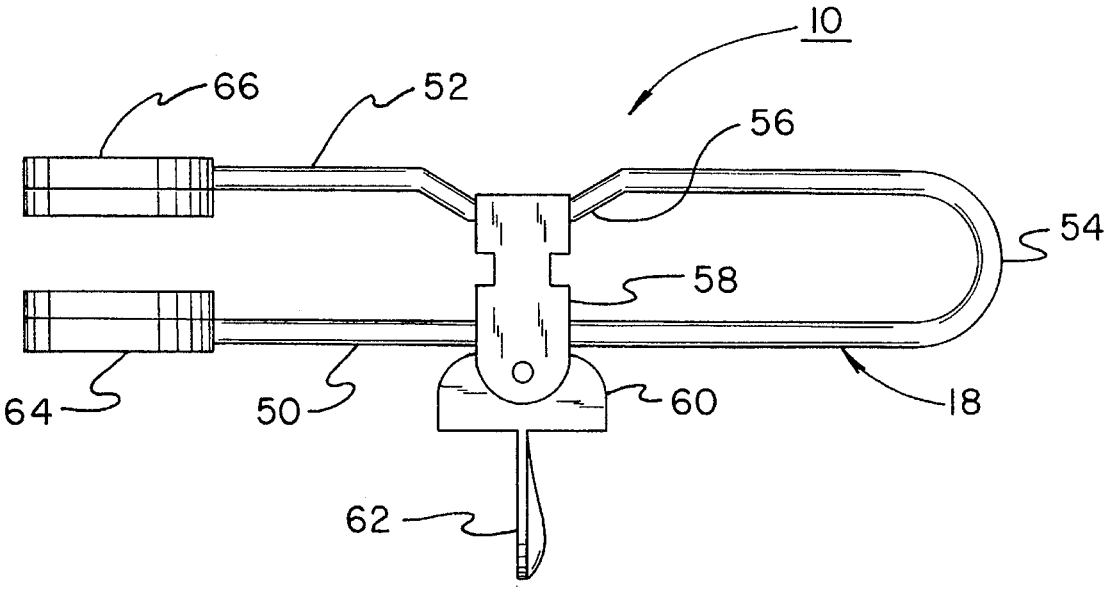
FIG. 6 is an elevation view of a clip means comprising a portion of the present invention.

As shown in FIG. 6, the clip means 18 of the present invention 10 utilized for securing the section of canvas 16 to either of the support means 14 or 34 preferably comprises a first clamp leg 50 of substantially elongated configuration coupled to a second clamp leg 52 by an integral bend 54 extending therebetween. The second clamp leg 52 is oriented so as to extend into a substantially spaced and parallel orientation relative to the first clamp leg 50 and includes an integral detent notch 56. A U-shaped coupler 58 is positioned relative to the second clamp leg 52 so as to extend thereabout within the integral detent notch 56. The U-shaped coupler 58 includes a pair of spaced plates which extend over the first clamp leg 50, only one of such plates being illustrated in the elevation view of FIG. 6. A cam 60 is pivotally mounted between the plates of the U-shaped coupler 58 by an unlabelled pivot pin so as to capture the first clamp leg 50 between the cam 60 and the second clamp leg 52. A lever 62 extends from the cam 60 and can be selectively rotated relative to the U-shaped coupler 58 to effect biasing of the first clamp leg 50 relative to the second clamp leg 52. A first clamp pad 64 of substantially resilient construction is coupled to a distal end of the first clamp leg 50 and arranged so as to engage a second clamp pad 66 coupled to a distal end of the second clamp leg 52. By this structure, the clip means 18 of the present invention 10 can be utilized to capture a portion of the first wire frame 20 or the second wire frame 38 and a portion of the section of canvas 16 to retain the canvas relative to either of the wire frames. Preferably, the present invention 10 includes at least a pair of clip means 18, as shown in FIG. 1.

Figure 7:
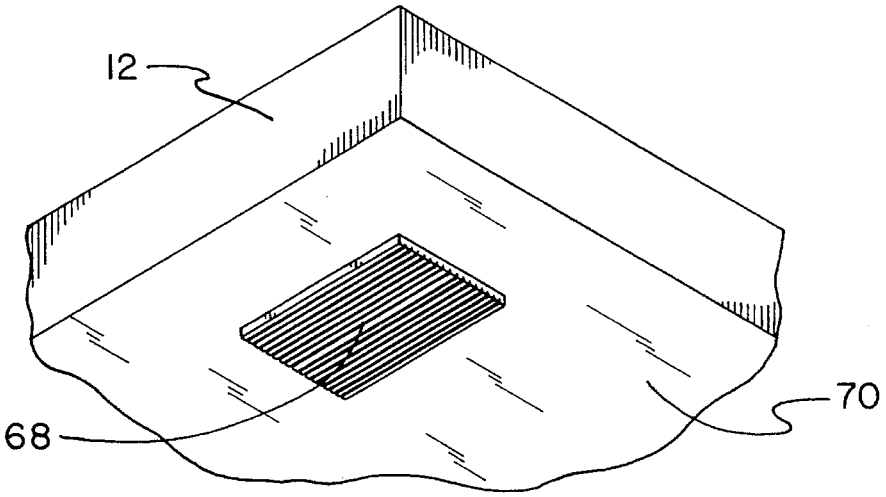
FIG. 7 is an enlarged isometric illustration of the area set forth in FIG. 2.

FIG. 7 illustrates that the base plate 12 may be provided with a plurality of gripping feet 68 secured to a bottom or lower surface 70 thereof which cooperate to discourage movement of the base plate 12 relative to the unillustrated supporting surface upon which it is positioned.

In use, the canvas holder 10 according to the present invention can be utilized to hold a section of canvas 16 as illustrated in FIG. 1, whereby needlework can be performed on the canvas with both hands.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A canvas and holder system comprising:

a canvas with a periphery and a central extent for the performance of needlework thereon;

a base plate positionable upon a support surface with a plurality of gripping feet secured to a bottom surface thereof;

a first support means formed of a wire coupled to the base plate and extending upwardly therefrom at an oblique angle relative to the base plate supporting the canvas, wherein the wire frame is formed of a plastic coated wire; and clip means removably coupled to the first support means for securing a section of the canvas relative to the first support means, wherein the clip means comprises a first clamp leg of substantially elongated configuration; a second clamp leg coupled to the first clamp leg by an integral bend extending therebetween, the second clamp leg being oriented so as to extend into a substantially spaced and parallel orientation relative to the first clamp leg and including an integral detent notch formed therein; a U-shaped coupler positioned within the integral detent notch of the second clamp, the U-shaped coupler including a pair of spaced plates which extend over the first clamp leg; a cam pivotally mounted between the plates of the U-shaped coupler so as to capture the first clamp leg between the cam and the second clamp leg, a lever extending from the cam; a first clamp pad coupled to a distal end of the first clamp leg; and a second clamp pad coupled to distal end of the second clamp leg.

* * * * *